US006889021B2

(12) United States Patent
Lin et al.

(10) Patent No.: US 6,889,021 B2
(45) Date of Patent: May 3, 2005

(54) ELECTROPHOTOGRAPIC PRINTING APPARATUS INCLUDING A PHOTORECEPTOR BELT HAVING A DEFINED SHAPE

(75) Inventors: Chou-Jiung Lin, Hsinchu (TW); Chi-Chien Lin, Hsinchu (TW); Ming-Hung Hsu, Nantou (TW)

(73) Assignee: Aetes Technology Inc., Irvine, CA (US)

( * ) Notice: Subject to any disclaimer, the term of this patent is extended or adjusted under 35 U.S.C. 154(b) by 0 days.

(21) Appl. No.: 10/255,390

(22) Filed: Sep. 26, 2002

(65) Prior Publication Data

US 2004/0062569 A1 Apr. 1, 2004

(51) Int. Cl.[7] ..... G03G 15/00
(52) U.S. Cl. ..... 399/162; 399/164
(58) Field of Search ..... 399/159, 162, 399/164, 397, 400

(56) References Cited

U.S. PATENT DOCUMENTS 4,046,473 A * 9/1977 Trainor ..... 399/162
4,279,496 A * 7/1981 Silverberg ..... 399/164
5,652,648 A * 7/1997 Behe et al. ..... 399/164
5,666,599 A * 9/1997 Miyasaka et al. ..... 399/162
5,671,467 A * 9/1997 Katsumata et al. ..... 399/164
5,729,811 A * 3/1998 Takahata et al. ..... 399/397
5,732,312 A * 3/1998 Takekoshi et al. ..... 399/162
5,778,287 A * 7/1998 Yu ..... 399/162
6,163,661 A * 12/2000 Namekata et al.
6,188,860 B1 * 2/2001 Huang ..... 399/159
6,580,443 B2 * 6/2003 Yamaguchi et al.
2002/0172527 A1 * 11/2002 Nishiwaki et al.
2003/0068175 A1 * 4/2003 Asuwa et al. ..... 399/162
2003/0091364 A1 * 5/2003 Nishiwaki

FOREIGN PATENT DOCUMENTS

JP 2001075327 A * 3/2001 ..... G03G/15/01

* cited by examiner

*Primary Examiner*—Susan Lee
(74) *Attorney, Agent, or Firm*—Sonnenschein Nath & Rosenthal LLP

(57) ABSTRACT

Systems consistent with the present invention provide an electrophotographic printing apparatus that includes a group of developing units, a photoreceptor belt having an outer surface, and a group of support members operably disposed to support the movement of the photoreceptor belt along a path. The photoreceptor belt has a shape defined, at least in part, by the support members. The shape of the photoreceptor belt has at least two sides meeting at a transfer point. The first of the two sides extends at a first angle from the outer surface of the photoreceptor belt to a horizontal axis of the apparatus at the transfer point and the second of the two sides extends at a second angle from the outer surface of the photoreceptor belt to the horizontal axis such that the first and the second angles are each less than 90°. Each developing unit is disposed adjacent to the first or the second sides of the shape of the photoreceptor belt.

32 Claims, 5 Drawing Sheets

100
101

Tool 199
Processor 196
Memory 192
Secondary Storage 194
I/O Device 198
190
114
C1
140
160
172
150
L1
129
108
D1 130
131
133
112
170
174
D2 132
110
128
162
152
U1
176
142
C2
L2
116
102
D3 134
104
118
135
137
A
184
F1
D4 136
106
186
126
124
122
120
T1
189
188
180
182

ELECTROPHOTOGRAPIC PRINTING APPARATUS INCLUDING A PHOTORECEPTOR BELT HAVING A DEFINED SHAPE

FIELD OF THE INVENTION

The present invention relates generally to electrophotography, more particularly, to an electrophotographic color printing apparatus having a compact size.

BACKGROUND OF THE INVENTION

A conventional electrophotographic color printer has a photoreceptor drum or belt, charging units, exposure units, and developing units each with a different color toner disposed in relation to the photoreceptor drum or belt. In general, a region of the photoreceptor drum or belt receives a uniform charge from one of the charging units and then the charged region is exposed by one of the exposure units to form a charge pattern on the region (latent image) corresponding to a light image. To develop the latent image, the photoreceptor drum or belt then carries the latent image to one of the developing units where the latent image is exposed to an associated charged toner that adheres to charged portions of the latent image. If two or more color toners are required to develop the latent image, then the previous steps are repeated. Once the latent image is completely developed (all colors applied), the photoreceptor drum or belt transfers the developed latent image to paper or other substrate. Typically, the conventional electrophotographic color printer has a fuser unit that uses heat and pressure to affix or fuse the developed latent image to the substrate. The conventional electrophotographic color printer also has a cleaner unit that is disposed in relation to the photoreceptor drum or belt and is employed to remove excess toner that was not transferred to the paper as part of the developed latent image.

Typically, components of the conventional electrophotographic color printer, such as the photoreceptor drum or belt, the charging units, the exposure units, the developing units and the cleaner unit, are arranged such that the printer is inconveniently large in size. In an effort to reduce size, some conventional electrophotographic color printers arrange components such that heat generating components are located close to the photoreceptor drum or belt. This conventional arrangement subjects the photoreceptor drum or belt to undue heating, a problem that causes premature aging and substantial wear of the photoreceptor drum or belt.

In addition, conventional electrophotographic color printers, such as disclosed in Smith U.S. Pat. No. 5,313,259 and Maruyama U.S. Pat. No. 5,473,421, have a photoreceptor belt designed to travel an oblong or triangular path with charging units, exposure units and development units as well as a cleaning unit disposed along one or more external sides of the oblong or triangular path of the photoreceptor belt so as to reduce the overall size of the printer. But at least one of the development units is disposed in relation to the photoreceptor belt such that a portion of developed toner released from the one development unit to adhere to the latent image on the belt falls down due to gravity so as to contaminate a region of the belt other than where the latent image resides. Thus, the printing quality of the conventional electrophotographic color printer is reduced. In addition, the portion of developed toner may fall down on to another region of the belt where another latent image resides, causing the other latent image to be polluted or blurred.

Furthermore, the portion of developed toner from the one development unit may also fall and contaminate the toner of another development unit that is disposed beneath the one development unit.

Moreover, to achieve a compact size, the cleaning unit in conventional electrophotographic color printers, such as disclosed in the Maruyama Patent, is disposed in relation to the photoreceptor belt such that a portion of excess toner removed from the photoreceptor belt by a blade of the cleaner unit falls due to gravity to a lower region of the belt (and not directly to a waste container for easy removal), which potentially leads to contamination of a next latent image to be developed if the portion of excess toner is not "swept from" the lower region of the belt by the cleaner unit.

In addition, the conventional electrophotographic color printer typically has a transfer unit that is disposed at a bottom lateral plane of the photoreceptor belt. During transfer of the developed latent image from the photoreceptor belt to a sheet of paper or other substrate, the fed sheet is closely contacted with the transfer unit and the bottom lateral plane of the photoreceptor belt of the conventional electrophotographic color printer. If the movement of the belt along the bottom lateral plane is not fully synchronized with the fed sheet, the transfer of the developed latent image to the fed sheet may be blurred, twisted or unsuccessful. Therefore the synchronization of the transfer unit and the fed sheet is another problem in conventional electrophotographic color printers.

SUMMARY OF THE INVENTION

An electrophotographic printer apparatus consistent with the present invention is provided that overcomes the above-described problems to provide fast printing of an image in two or more colors while still having a compact size.

In accordance with articles of manufacture consistent with the present invention, an electrophotographic printing apparatus is provided that includes a photoreceptor belt having an outer surface, and a support member operably disposed to support the movement of the photoreceptor belt along a path. The photoreceptor belt has a shape defined by the support member. The shape of the photoreceptor belt has at least two sides meeting at a transfer point. The first of the two sides extends at a first angle measured from the outer surface of the photoreceptor belt to a horizontal axis of the apparatus at the transfer point and the second of the two sides extends at a second angle measured from the outer surface of the photoreceptor belt to the horizontal axis at the transfer point. The first and the second angles are each less than 90.° The electrophotographic printing apparatus also includes a group of developing units. Each of the developing units is disposed adjacent to one of the first and second sides of the shape of the photoreceptor belt so that any developed toner associated with any of the developing units that falls due to gravity will fall away from the photoreceptor belt and not substantially contaminate any developing unit.

The electrophotographic printing apparatus may also include a cleaning unit disposed adjacent to one of the first and second sides of the shape of the photoreceptor belt and adapted to remove excess toner from the outside surface of the photoreceptor belt. The cleaning unit is disposed such that any excess toner removed by the cleaning unit does not fall, due to gravity, back to the outside surface of the photoreceptor belt.

The electrophotographic printing apparatus may also include a transfer unit that has a roller disposed adjacent to a lower apex of the support member at the transfer point. The roller is adapted to move in unison with the photoreceptor belt when a substrate sheet is fed between the roller of the transfer unit and the lower member so that a developed latent image on the photoreceptor belt is transferred to the substrate sheet without binding the substrate sheet.

The electrophotographic printing apparatus may also include two charging units disposed adjacent to the photoreceptor belt, two exposure units disposed adjacent to the photoreceptor belt, and a controller operably connected to the charging units, the exposure units, and the developing units. The controller is operably configured to selectively cause each of the charging units to provide in succession an electrostatic charge on a region of the photoreceptor belt during one pass of the photoreceptor belt and to selectively cause each of the exposure units to expose in succession the selectively charged region to produce a corresponding latent image on the region during the one pass of the photoreceptor belt. In addition, the controller may selectively cause a first of the developing units to develop the latent image produced by the first of the two exposure units and then selectively cause a second of the developing units to develop the latent image produced by the second of the two exposure units such that a developed latent image having two colors is produced on the region in the one pass of the photoreceptor belt.

The controller may also selectively cause the two charging units to each provide in succession an electrostatic charge on the region of the photoreceptor belt that has the latent image developed after the first pass of the photoreceptor belt. The controller may also cause the two exposure units to expose in succession the selectively charged region to produce another corresponding latent image on the region during the second pass of the photoreceptor belt. The controller may also selectively cause a third of the developing units to develop the latent image produced by the first exposure unit during the second pass of the photoreceptor belt. The controller may also selectively cause a fourth of the developing units to develop the latent image produced by the second exposure unit during the second pass of the photo receptor belt such that the developed latent image has four colors after two successive passes of the photoreceptor belt.

BRIEF DESCRIPTION OF THE DRAWINGS

In the figures, like reference numerals designate corresponding parts throughout the different views. The invention may take physical form in certain parts of which will be described in detail in this specification and illustrated in the accompanying drawings, which form a part hereof, wherein.

DETAILED DESCRIPTION OF PREFERRED EMBODIMENTS

An electrophotographic printing apparatus consistent with the present invention has a photoreceptor belt and associated components (such as charging units, exposure units, developing units, and a cleaner unit) arranged to provide the electrophotographic printing apparatus with a compact size while substantially eliminating the above-identified problems found in conventional compact printers (such as excess toner from a cleaning unit falling back on to the photoreceptor belt due to gravity).

Figure 1:
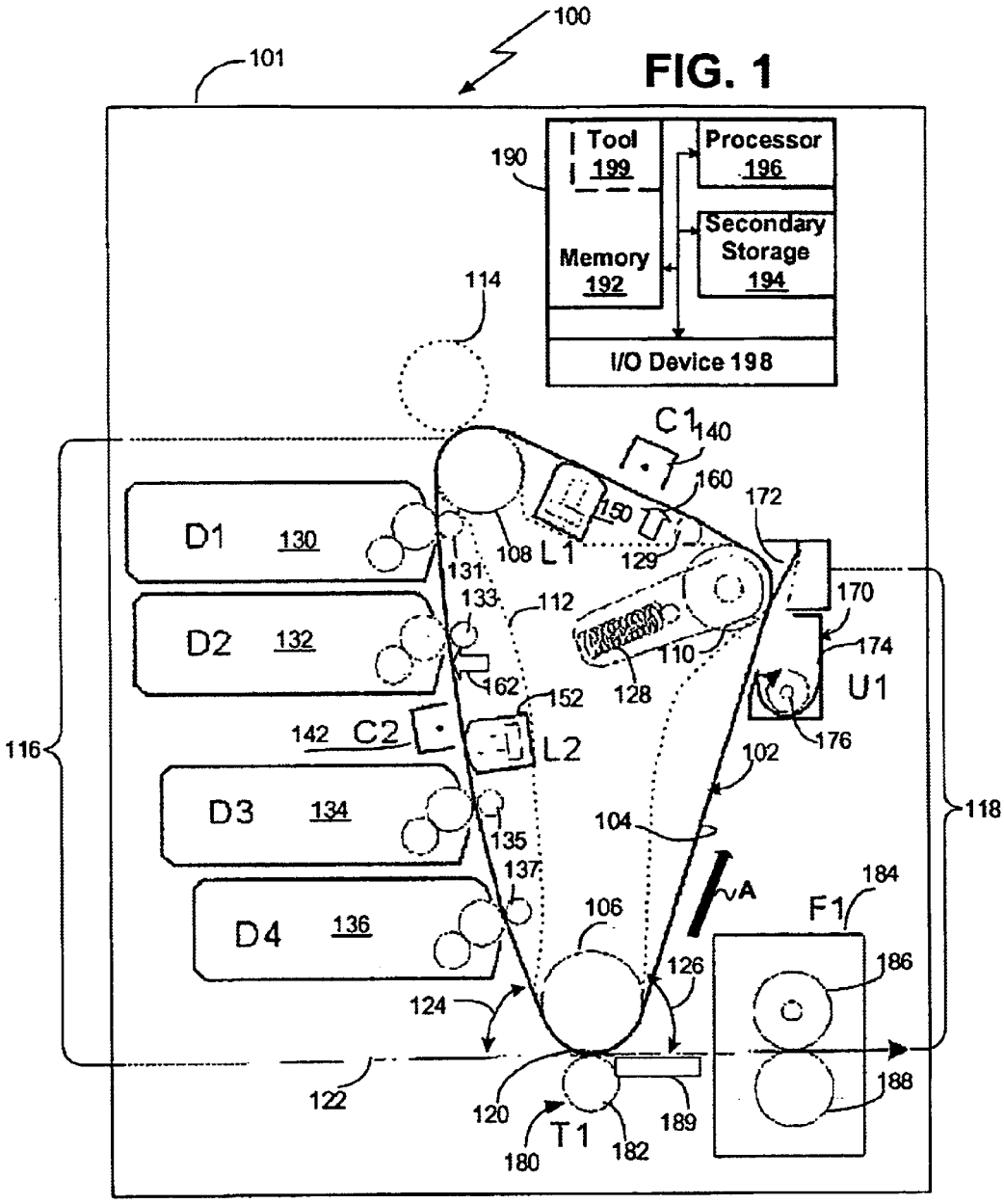
FIG. 1 is a schematic side view illustrating an exemplary electrophotographic printer apparatus embodying aspects of the present invention.

In FIG. 1, an exemplary electrophotographic printer apparatus 100 embodying aspects of the present invention is shown in a schematic side view. The electrophotographic printing apparatus 100 includes a photoreceptor belt 102 having an outer surface 104, and a group of support members 106, 108, and 110, such as rollers, operably disposed to support the movement of the photoreceptor belt 102 along a path in a direction indicated by arrow A in FIG. 1. The electrophotographic color printing apparatus 100 may also include a housing 101 that encloses the photoreceptor belt 102 and the support members 106, 108, and 110.

As shown in FIG. 1, the photoreceptor belt 102 has a shape defined, at least in part, by the support members 106, 108, and 110. In another implementation, the support members 106, 108, and 110 may be incorporated into a single support member 112 positioned within the photoreceptor belt 102 so that the photoreceptor belt 102 has the same shape as defined, at least in part, by support members 106, 108, and 110. The photoreceptor belt 102 may also have features, such as ridges, projections, or non-uniform thickness (not shown in figures), that also contribute to defining the belt shape when the photoreceptor belt 102 is positioned on the support members 106, 108, and 110. In this implementation, the electrophotographic printing apparatus 100 may have a roller 114 positioned in relation to the photoreceptor belt 102 and the single support member 112 such that the photoreceptor belt 102 moves along the path or the shape of the photoreceptor belt 102 when the roller 114 is operated.

The shape of the photoreceptor belt 102 has at least two sides 116 and 118 that meet at a transfer point 120, where a developed latent image on the photoreceptor belt is transferred to a substrate, such as paper, as described in further detail below. The transfer point 120 may be an edge of the photoreceptor belt 102 that corresponds to an apex formed in the photoreceptor belt 102 by the single support member 112 or one of the group of support members 106, 108, and 110. For example, the support members 106, 108, and 110 may include a lower member (i.e., 106) and two upper members (i.e., 108 and 110). In this implementation, the first side 116 of the shape of the photoreceptor belt 102 extends from one of the upper members (i.e., 108) to the lower member 106 and the second side 118 of the shape extends from the lower member 106 to another of the two upper members (i.e., 110). The shape of the photoreceptor 102 in this implementation is triangular, preferably a non-equilateral triangular that minimizes a length of the photoreceptor belt 102 so that the electrophotographic printer apparatus 100 may have an optimal compact size.

In another implementation, the transfer point 120 may be along another side or plane of the photoreceptor shape (not shown in FIG. 1) other than the first and second side 116 and 118. In this other implementation, the shape of the photoreceptor belt 102 may be a polygon having at least four sides.

The first of the two sides (e.g., first side 116 of the photoreceptor belt's shape) extends at a first angle 124 measured from the outer surface 104 of the photoreceptor belt 102 to a horizontal axis 122 of the apparatus 100 at the transfer point 120. The second of the two sides (e.g., second side 118 of the photoreceptor belt's shape) extends at a second angle 126 measured from the outer surface 104 of the photoreceptor belt to the horizontal axis 122. The first and the second angles 124 and 126 are each less than 90° so that toner associated with components arranged along the first side 116 or the second side 118, as identified below, does not fall due to gravity on to the photoreceptor belt 102 as described in further detail herein.

The first and the second angles 124 and 126 may each be within the range of 35° and 89°, and preferably within the range of 50° and 80,° to further inhibit toner associated with components arranged along the first side 116 or the second side 118 from falling due to gravity on to the photoreceptor belt 102.

The electrophotographic printing apparatus 100 may also include a bias means 128 that is operably coupled to one (e.g., support member 110) of the support members 106, 108, and 110 for biasing the one support member (e.g., support member 110) towards the photoreceptor belt 102 to maintain a tension on the photoreceptor belt 102. The tension provided by the bias means 128 is sufficient to maintain support of the photoreceptor belt 102 so as to substantially inhibit the belt 102 from slipping, which may otherwise occur after extended use of the photoreceptor belt 102.

In addition, the electrophotographic printing apparatus 100 may also include a first holding member 129 disposed between a first charging unit 140 and the one support member 110 operably coupled to the bias means 128. The first holding element 129 is in contact with the photoreceptor belt 102 such that the first holding element 129 substantially inhibits a variation of the length of the photoreceptor belt 102 between the first charging unit 140 and a first exposure unit 150 in response to biasing the one support member 110 towards the photoreceptor belt 102.

Continuing with FIG. 1, in one implementation, the electrophotographic printer apparatus 100 may have one developing unit 130, one charging unit 140, one exposure unit 150, and one single eraser unit 160 compactly arranged in relation to the photoreceptor belt 102 as disclosed herein to support monochrome or single color printing.

In another implementation, the developing unit 130 may be one of a group of two or more developing units (e.g., two of 130, 132, 134, and 136). In this implementation, each developing unit (e.g., 130, 132, 134, and 136) may have an associated toner of a different color such that the electrophotographic printer apparatus 100 is able to support at least two color printing. As shown in FIG. 1, the developing unit 130 may be one of a group of four or more developing units (e.g., 130, 132, 134, and 136) where each developing unit (e.g., 130, 132, 134, and 136) may have an associated toner of a different color such that the electrophotographic printer apparatus 100 is able to support at least four color printing.

Each of the developing units 130, 132, 134, and 136 is adapted to provide a portion of the toner associated with the developing unit for transfer to a latent image on the photoreceptor belt 102 (a region on the photoreceptor belt having an electrostatic charge pattern) when in an "ON" state. The transferred toner portion (or developed toner) associated with the respective developing unit (e.g., 130, 132, 134, and 136) results in a developed latent image having the color of the associated toner.

Each developing unit 130, 132, 134, and 136 may be disposed adjacent to either the first side 116 or the second side 118 of the shape of the photoreceptor belt 102. As shown in FIG. 1, the developing units 130, 132, 134, 136, may be staggered vertically along the either the first side 116 or the second side 118 of the shape of the photoreceptor belt 102 such that any of the transferred toner portion or developed toner associated with a respective developing unit 130, 132, 134, and 136 falls due to gravity away from the photoreceptor belt such that the photoreceptor belt 102 is not contaminated by the developed toner and developing units (e.g., 132, 134, and 136) disposed vertically beneath the respective developing unit (e.g., 130) are not contaminated.

To accommodate the removal and replacement of the developing units 130, 132, 134, and 136 from one end of the housing 101 and to minimize the travel of the photoreceptor belt 102 for printing an image in two or more colors, the developing units 130, 132, 134, and 136 are preferably positioned along the first side 116 of the shape of the photoreceptor belt 102. In this implementation, the first side 116 is longer than the second side 118.

As shown in FIG. 1, the electrophotographic printing apparatus 100 may also include a group of holding members 131, 133, 135, and 137. Each of the holding members 131, 133, 135, and 137 is positioned to be in contact with the photoreceptor belt 102 near a respective one of the group of developing units 130, 132, 134, and 136 such that each holding member 131, 133, 135, and 137 maintains a respective gap between the holding member and the respective one of the group of developing units 130, 132, 134, and 136. By maintaining a respective gap, the holding members 131, 133, 135, and 137 increase the accuracy of developing a latent image by the developing units 130, 132, 134, and 136.

To accommodate two or more color printing, the electrophotographic printer apparatus 100 may include a group of charging units 140 and 142. Each charging units 140 and 142 may be an AC or DC corona, corotron, scorotron, dicorotron, pin scorotron or any other device capable of setting up a uniform electrostatic field on a region of the photoreceptor belt 102 where a latent image is to be developed by one of the developing units 130, 132, 134, and 136 when the one developing unit is in the "ON" state. Each charging unit 140 and 142 is disposed adjacent to the outer surface 104 of the photoreceptor belt. A first (e.g., 140) of the group of charging units 140 and 142 is disposed upstream of the developing units 130, 132, 134, and 136 with respect to a direction of movement of the photoreceptor belt 102. As illustrated in FIG. 1, the direction of movement is indicated by the arrow A. A second (e.g., 142) of the group of charging units 140 and 142 is disposed upstream of a portion of the group of developing units with respect to the direction of movement of the photoreceptor belt.

To accommodate two or more color printing, the electrophotographic printer apparatus 100 may also include a group of exposure units 150 and 152. Each of the exposure units 150 and 152 is a light source, such as a laser or a light-emitting diode ("LED") printer head ("LPH"), that is capable of projecting a respective light pattern onto the region of the photoreceptor belt 102 having the uniform electrostatic field (as provided by one of the charging units 140 and 142) such that the uniform electrostatic field is partially discharged to produce the latent image to be developed by one of the developing units 130, 132, 134, and 136 when the one developing unit is in the "ON" state. Each of the exposure units 150 and 152 is disposed adjacent to the photoreceptor belt. A first (e.g., 150) of the exposure units 150 and 152 is disposed downstream of the first charging unit 140 with respect to the direction of movement of the photoreceptor belt 102. A second (e.g., 152) of the exposure units 150 and 152 is disposed downstream of the second charging unit 142.

Each charging unit 140 and 142 may be used in association with any one of the exposure units 150 and 152 to produce the latent image to be developed by one of the developing units 130, 132, 134, and 136. To develop the latent image in two or more colors, the first charging unit 140 is preferably used in association with the first exposure unit 150 and the second charging unit 142 is preferably used in association with the second exposure unit 152 such that the latent image may be developed in two colors in one pass of the photoreceptor belt 102 or in four colors in two passes of the photoreceptor belt 102. One pass of the photoreceptor belt 102 corresponds to a developed latent image on the photoreceptor belt 102 passing the transfer point 120 once to minimize the travel of the photoreceptor belt 102. For example, the first charging unit 140 and the first exposure unit 150 may provide a first latent image for the developing unit 130 in a first pass and provide a second latent image for the developing unit 132 on a second pass. Similarly, the second charging unit 142 and the second exposure unit 152 may provide a third latent image for the developing unit 134 in the first pass and provide a fourth latent image for the developing unit 136 in the second pass.

The electrophotographic printer apparatus 100 may also include a group of eraser units 160 and 162. Each of the eraser units 160 and 162 is adapted to substantially discharge the region before one of the charging units 140 and 142 is selected to provide the region with a uniform electrostatic charge. Each of the eraser units 160 and 162 is disposed adjacent to the photoreceptor belt. A first (e.g., 160) of the eraser units 160 and 162 is disposed upstream of the first charging unit 140 with respect to the direction of movement of the photoreceptor belt 102. A second (e.g., 162) of the eraser units 160 and 162 is disposed upstream of the second charging unit 142.

As indicated above, the electrophotographic printer apparatus 100 may include the cleaning unit 170, which may be disposed adjacent to either the first side 116 or the second side 118 of the shape of the photoreceptor belt 102. In the one implementation shown in FIG. 1, the developing units 130, 132, 134, and 136 are disposed on the first side 116 while the cleaning unit 170 is disposed on the second side 118 so as to minimize the length of the photoreceptor belt 102. The cleaning unit 170 may include a scraping element 172 adapted to selectively contact the photoreceptor belt to substantially remove excess toner on the photoreceptor belt 102 that is not transferred to a substrate sheet. The cleaning unit 170 may also include a collection chamber 174 aligned with the scraping element such that the removed excess toner fails due to gravity into the collection chamber 174.

Figure 2A:
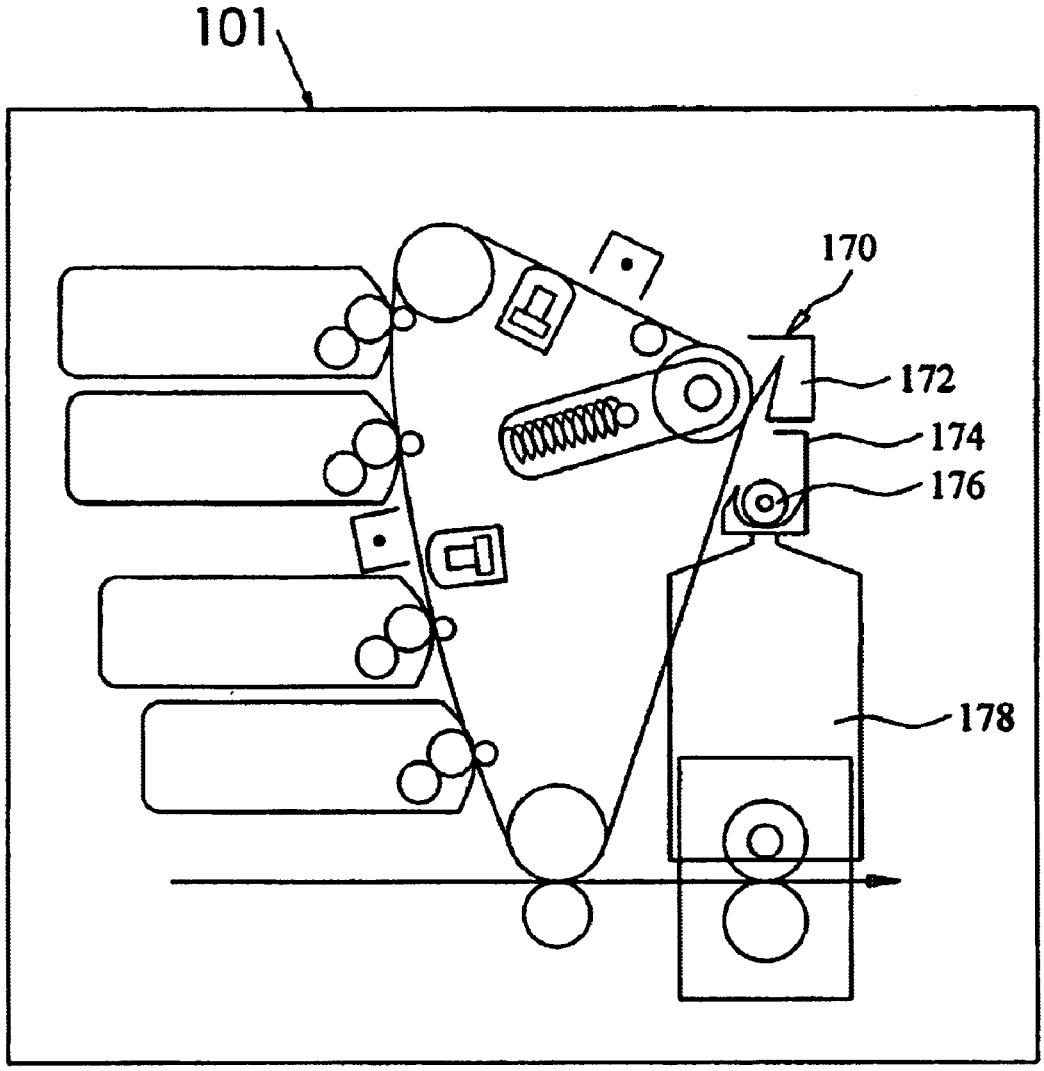
FIG. 2A is a side view of the electrophotographic printer apparatus shown in FIG. 1.
Figure 2B:
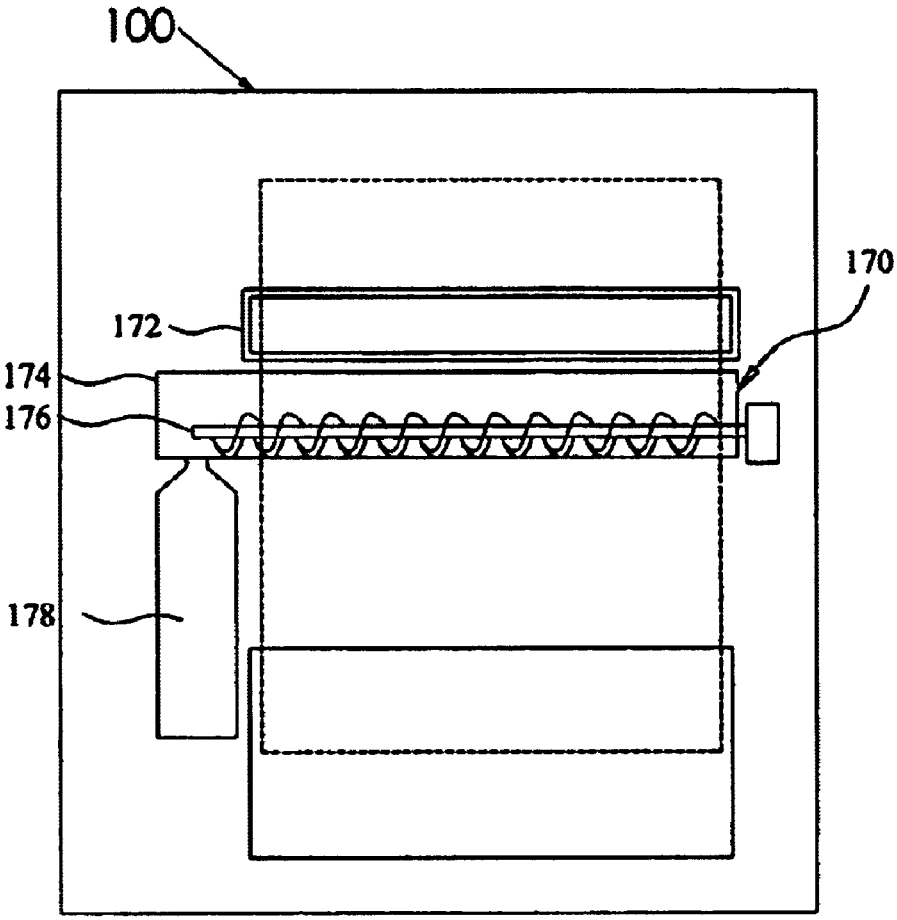
FIG. 2B is an end view of the electrophotographic printer apparatus shown in FIG. 1.

As shown in FIG. 2, the cleaning unit 170 may also include a removal element 176, such as an auger, and a waste container 178. The removal element 176 is disposed within the collection chamber 174 and is operably configured to remove toner in the collection chamber towards the waste container 178. The waste container 178 is removably coupled to an end of the cleaning unit 170 and disposed within the housing 101 such that waste container 178 is in a vertical plane of the housing different from the photoreceptor belt 102. In this implementation, the waste container 178 may have a large size of approximately 820 $cm^3$ or less in volume, which does not interfere with the operation of the photoreceptor belt 102 and allows for infrequent removal of the waste container 178 by a user for disposal of the toner therein.

Figure 3:
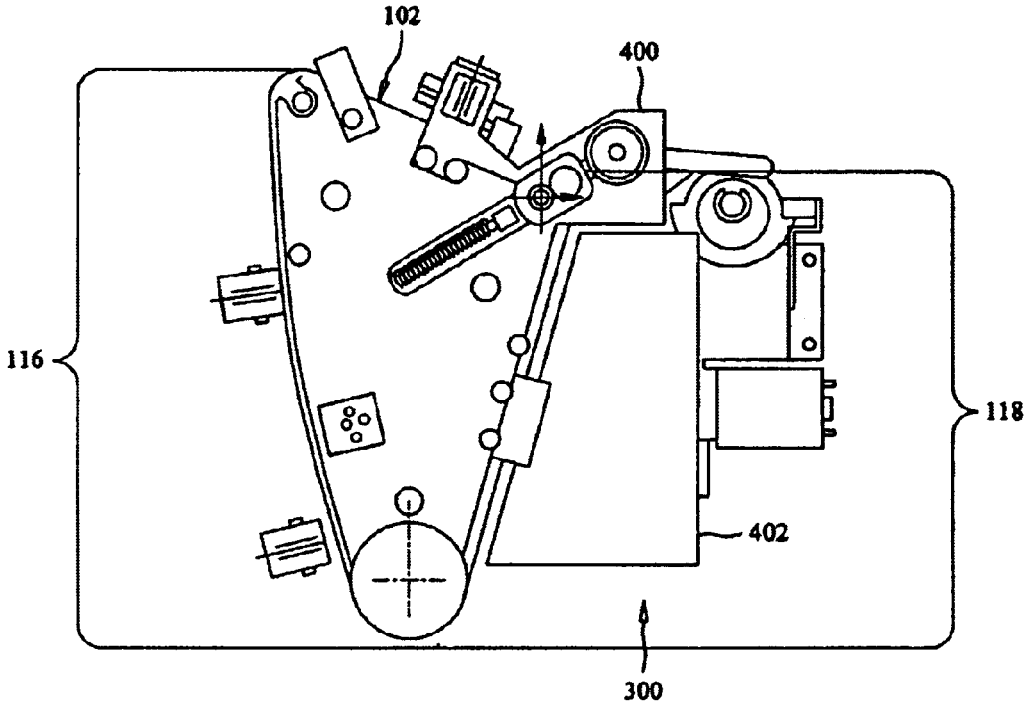
FIG. 3 is side view illustrating another exemplary electrophotographic printer apparatus embodying aspects of the present invention.

In another implementation depicted in FIG. 3, electrophotographic printer apparatus 100 may include a cleaning unit 300 which may be disposed adjacent to either the first side 116 or the second side 118 of the shape of the photoreceptor belt 102. In this implementation, the developing units 130, 132, 134, and 136 (not shown in FIG. 3) are disposed on the first side 116 while the cleaning unit 300 is disposed on the second side 118 so as to minimize the length of the photoreceptor belt 102. The cleaning unit 300 is removable and may span a substantially portion of the second side 118 such that the cleaning unit 300 may operate to collect excess toner that falls from the photoreceptor belt 102 due to gravity. The cleaning unit 300 preferably has a width equal to or exceeding the width of the photoreceptor belt 102. In a preferred implementation, the cleaning unit 300 extends the approximate length of the second side 118 to optimize the collection of excess toner without removing the cleaning unit 300 for deposal of the excess toner therein.

Figure 4:
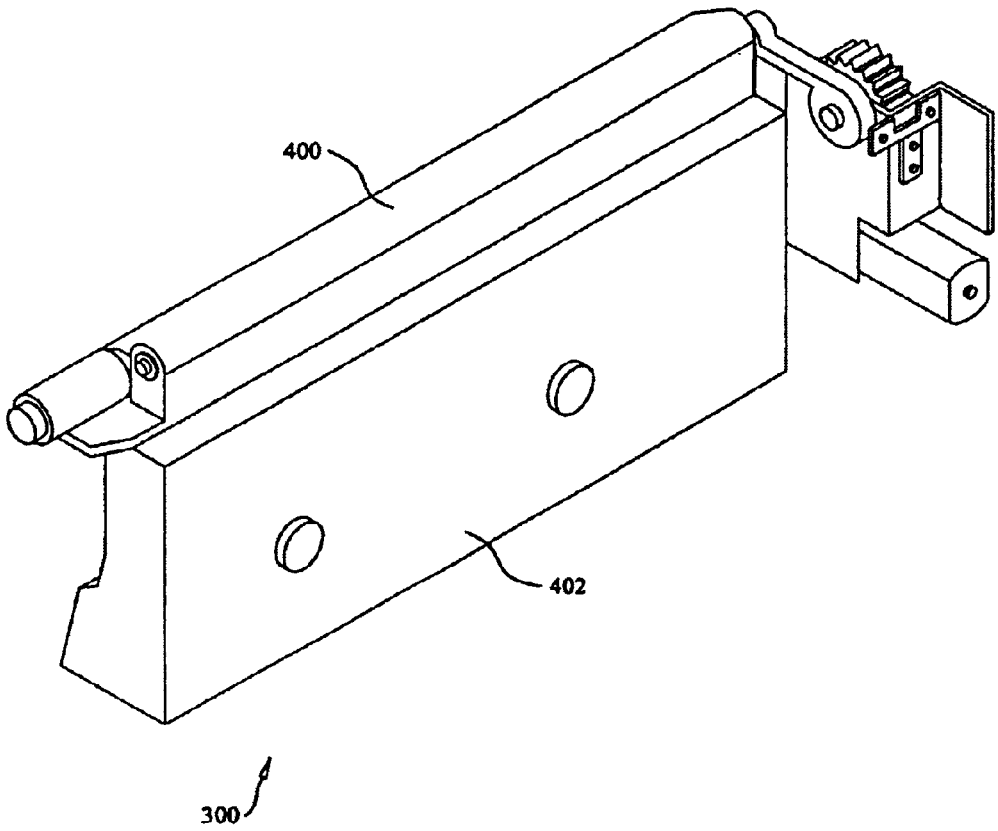
FIG. 4 is a perspective view of an exemplary cleaner unit for the electrophotographic printer apparatus shown in FIG. 3.

As shown in FIG. 4, the cleaning unit 300 may include a blade mechanism or scraping element 400 adapted to selectively contact the photoreceptor belt 102 to substantially remove excess toner on the photoreceptor belt 102 that is not transferred to a substrate sheet. The cleaning unit 300 may also include a removable collection chamber 402 aligned with the scraping element 400 such that the removed excess toner fails due to gravity into the collection chamber 402. Because the collection chamber 402 is adapted to span a substantially portion or the length of the second side 118, the collection chamber 402 may be sized larger than the collection chamber 174 and may collect excess toner without removal element 176 or waste container 178. In this implementation, the collection chamber 402 may have a large size of approximately 820 $cm^3$ or more in volume, which does not interfere with the operation of the photoreceptor belt 102 and allows for infrequent removal of the waste container 402 by a user for disposal of the toner therein.

Referring again to the implementation shown in FIG. 1, the developing units 130, 132, 134, and 136, the charging units 140 and 142, the exposure units 150 and 152, the eraser units 160 and 162 and the cleaning unit 170 are arranged in relation to the photoreceptor belt 102 such that the photoreceptor belt 102 has a length of approximately 420 mm or less, allowing the electrophotographic printer apparatus 100 to have a compact size without the above-identified printing problems of the conventional color printers.

The electrophotographic printer apparatus 100 may also include a transfer unit 180 having a roller 182 disposed adjacent to the lower member 106 of the support members 106, 108, and 110 or the lower apex 106 of the single support member 112 at the transfer point 120. The roller 182 is adapted to move in unison with the photoreceptor belt 102 when a substrate sheet is fed between the roller 182 of the transfer unit 180 and the lower member or apex 106 so that a developed latent image on the photoreceptor belt 102 is transferred to the substrate sheet. In one implementation, the roller 182 and the lower member or apex 106 are substantially aligned vertically.

The electrophotographic printer apparatus 100 may also include a fuser unit 184 disposed to receive the substrate sheet from the roller 182 of the transfer unit 180. The fuser unit 184 is operably configured to thermally fuse the developed latent image to the surface of the substrate as it passes through the fuser unit 184. In the implementation shown in FIG. 1, the fuser unit has two rollers 186 and 188 that thermally fuse the developed latent image to the substrate as it passes between the rollers 186 and 188. As shown in FIG. 1, the transfer unit 180 may have a non-moving support member 189 disposed between the roller 182 of the transfer unit 180 and the fuser unit 184. The non-moving support member 189 is adapted to support the substrate sheet while the substrate sheet is received by the fuser unit. In addition, the non-moving support member allows the fuser unit 184 to be disposed substantially away from the photoreceptor belt 102, which extends the life of the photoreceptor belt 102.

The electrophotographic printing apparatus 100 also includes a controller 190 that is operably connected to the charging units 140 and 142, the exposure units 150 and 152, and the developing units 130, 132, 134, and 136 so as to control the operation of these units. The controller may also be operably connected (e.g., via a motor not shown in the figures) to at least one of the support members 106, 108, and 110 to control the movement of the photoreceptor belt 102 in relation to the support members 106, 108, and 110. The controller is operably configured to substantially synchronize the operation of the charging units 140 and 142, the exposure units 150 and 152, and the developing units 130, 132, 134, and 136 with the movement of the photoreceptor belt 102.

In the implementation where the printing apparatus 100 has the single support member 112, the controller 190 may be operably connected to the roller 114 to control the movement of the photoreceptor belt 102 in relation to the single support member 114 in substantial synchronization with the operation of the charging units 140 and 142, the exposure units 150 and 152, and the developing units 130, 132, 134, and 136.

The controller 190 may include a memory 192, a secondary storage device 194, a processor 196, and an I/O device 198. Memory 192 may include a printing tool 199, which may be a sequence of instructions to be run by the controller 190 via the processor 196. In an alternative implementation, the controller may include an Application Specific Integrated Circuit (ASIC), or other known programmable device, that is configured to run the printing tool 199.

Although aspects of the present invention, such as printing tool 199, are described as being stored in memory, one skilled in the art will appreciate that these aspects can also be stored on or read from other types of computer-readable media, such as secondary storage devices, like hard disks, floppy disks or CD-ROM; a carrier wave from a network, such as the Internet; or other forms of RAM or ROM either currently known or later developed.

When running the printing tool 199, the controller 190 may selectively cause the first and second charging units 140 and 142 to each provide in succession an electrostatic charge, preferably an uniform electrostatic charge, on a region of the photoreceptor belt 102 during one pass (e.g., the first of two passes) of the photoreceptor belt 102. The controller 190 may also cause the first and second exposure units 150 and 152 to each expose in succession the selectively charged region to produce a corresponding latent image on the region during the one pass of the photoreceptor belt. In addition, the controller 190 may selectively cause a first of the developing units 130, 132, 134, and 136 to be in the "ON" state to develop the latent image produced by the first exposure unit 150 and then selectively cause a second of the developing units 130, 132, 134, and 136 to be in the "ON" state to develop the latent image produced by the second exposure unit 152 such that a developed latent image having two colors is produced on the region in the one pass of the photoreceptor belt 102.

When running the printing tool 199 during a second successive pass of the photoreceptor belt 102, the controller 190 may also selectively cause the first and second charging units 140 and 142 to each provide in succession an electrostatic charge, preferably an uniform electrostatic charge, on the region of the photoreceptor belt 102 that has the latent image developed with two colors during the first pass of the photoreceptor belt 102. The controller 190 may also cause the first and second exposure units 150 and 152 to each expose in succession the selectively charged region to produce another corresponding latent image on the region during the second pass of the photoreceptor belt. The controller 190 may also selectively cause a third of the developing units 130, 132, 134, and 136 to develop the latent image produced by to the first exposure unit 142 during the second pass of the photoreceptor belt 102. The controller 190 may also selectively cause a fourth of the developing units 130, 132, 134, and 136 to develop the latent image produced by the second exposure unit 152 during the second pass of the photo receptor belt such that the developed latent image has four colors after two successive passes of the photoreceptor belt.

Moreover, the controller 190 using printing tool 199 is able to print a monochrome or one color image in one pass of the photoreceptor belt 102 in accordance with methods and systems consistent with the present invention. As previously mentioned, the controller is configured to identify one pass of the photoreceptor belt 102 as corresponding to a developed latent image on the photoreceptor belt 102 passing the transfer point 120 once to minimize the travel of the photoreceptor belt 102. When the electrophotographic printer apparatus 100 has four or more developing stations 130, 132, 134, and 136 (corresponding to D1, D2, D3, and D4), two or more charging stations 140 and 142 (corresponding to C1 and C2), and two or more exposure stations 150 and 152 (corresponding to L1 and L2) as shown in FIG. 1, the controller 190 may cause a monochrome image to be printed in one pass using at least the following combination of components, among others: [C1+L1+D1] or [C1+L1+D2] or [C1+L1+D3] or [C1+L1+D4] or [C2+L2+D3] or [C2+L2+D4] or [C2+L2+D1] or [C2+L2+D2].

The controller 190 using printing tool 199 is also able to print a two color image in one or two passes of the photoreceptor belt 102 in accordance with methods and systems consistent with the present invention. As identified above, the controller may be configured to identify one pass of the photoreceptor belt 102 as corresponding to a developed latent image on the photoreceptor belt 102 passing the transfer point 120 once to minimize the travel of the photoreceptor belt 102. When the electrophotographic printer apparatus 100 has four or more developing stations 130, 132, 134, and 136, two or more charging stations 140 and 142, and two or more exposure stations 150 and 152 as shown in FIG. 1, the controller 190 may cause a two color image to be printed in one pass using one of the following combinations of components, among others: ([C1+L1+D1]+[C2+L2+D3]) or ([C1+L1+D1]+[C2+L2+D4]) or ([C1+L1+D2]+[C2+L2+D3]) or ([C1+L1+D2]+[C2+L2+D4]).

In addition, the controller 190 may be operably configured to determine that one of the two charging units 140 and 142 (i.e., C1 or C2) is inoperable or that one of the two exposure charging units 150 and 152 (i.e., L1 or L2) is inoperable so that the controller 190 causes the two color image to be printed in two or more passes using on of the following combinations, among others: [Pass-one(C1+L1+D1)+pass-two(C1+L1+D2)] or [Pass-one(C3+L2+D3)+Pass-two(C2+L2+D4)].

The controller 190 using printing tool 199 may also print a four color image in two or more passes of the photoreceptor belt 102 in accordance with methods and systems consistent with the present invention. As identified above, the controller may be configured to identify one pass of the photoreceptor belt 102 as corresponding to a developed latent image on the photoreceptor belt 102 passing the transfer point 120 once to minimize the travel of the photoreceptor belt 102. When the electrophotographic printer apparatus 100 is configured as shown in FIG. 1, the controller 190 may perform the process depicted in FIG. 5 to print a four color image in two passes using one of the following combinations of components, among others: {Pass-one[(C1+L1+D1)+(C2+L2+D3)]+pass-two[(C1+L1+D2)+(C2+L2+D4)]}.

In addition, the controller 190 may determine that one of the two charging units 140 and 142 (i.e., C1 or C2) is inoperable or that one of the two exposure charging units 150 and 152 (i.e., L1 or L2) is inoperable so that the controller 190 causes the four color image to be printed in two or more passes using one of the following combinations, among others:

[Pass-one(C1+L1+D1)+Pass-two(C1+L1+D2)+Pass-three (C1+L1+D3)+Pass-four (C1+L1+D4)] or

[Pass-one(C2+L2+D1)+Pass-two(C2+L2+D2)+Pass-three (C2+L2+D3)+Pass-four (C2+L2+D4)].

While various embodiments of the application have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. An electrophotographic printing apparatus comprising:

a photoreceptor belt having an outer surface;

a support member operably disposed to support the movement of the photoreceptor belt along a path, the photoreceptor belt having a shape defined, at least in part, by the support member, the shape of the photoreceptor belt having at least two sides meeting at a transfer point, the first of the two sides extending at a first angle measured from the outer surface of the photoreceptor belt to a horizontal axis of the apparatus at the transfer point and the second of the two sides extending at a second angle measured from the outer surface of the photoreceptor belt to the horizontal axis at the transfer point, the first and the second angles are each less than 90°, and a plurality of developing units, each developing unit disposed adjacent to one of the first and second sides of the shape of the photoreceptor belt.

2. The electrophotographic printing apparatus of claim 1, further comprising a transfer unit that has a roller disposed adjacent to a lower apex of the support member at the transfer point.

3. The electrophotographic printing apparatus of claim 2, wherein the roller is adapted to move in unison with the photoreceptor belt when a substrate sheet is fed between the roller of the transfer unit and a lower member.

4. The electrophotographic printing apparatus of claim 1, further comprising a cleaning unit disposed adjacent to a side opposite to the one of the first and second sides where the plurality of developing units are disposed.

5. The electrophotographic printing apparatus of claim 4, wherein the cleaning unit has:

a scraping element adapted to selectively contact the photoreceptor belt to substantially remove excess toner on the photoreceptor belt not transferred to a substrate sheet, and a collection unit aligned with the scraping element such that the removed excess toner falls due to gravity into a collection chamber.

6. The electrophotographic printing apparatus of claim 4, wherein the cleaning unit is disposed adjacent to the second side of the shape of the photoreceptor belt and each of the plurality of developing units is disposed adjacent to the first side of the shape of the photoreceptor belt.

7. The electrophotographic printing apparatus of claim 1, wherein the support member is one of a plurality of support members defining the shape of the photoreceptor belt.

8. The electrophotographic printing apparatus of claim 7, further comprising a bias means operably coupled to one of the support members for biasing the support member towards the photoreceptor belt to maintain a tension on the photoreceptor belt.

9. The electrophotographic printing apparatus of claim 7, wherein each of the support members is a roller.

10. The electrophotographic printing apparatus of claim 1, wherein the plurality of developing units are staggered vertically along the one of the first and second sides of the shape of the photoreceptor belt.

11. An electrophotographic apparatus comprising:

a photoreceptor belt having an outer surface;

a support member operably disposed to support the movement of the photoreceptor belt along a path, the photoreceptor belt having a shape defined, at least in part, by the support member, the shape of the photoreceptor belt having at least two sides meeting at a transfer point, the first of the two sides extending at a first angle measured from the outer surface of the photoreceptor belt to a horizontal axis of the apparatus at the transfer point and the second of the two sides extending at a second angle measured from the outer surface of the photoreceptor belt to the horizontal axis at the transfer point, the first and the second angles are each less than 90°;

a plurality of developing units, each developing unit disposed adjacent to one of the first and second sides of the shape of the photoreceptor belt; and a cleaning unit disposed adjacent to a side opposite to the one of the first and second sides where the plurality of developing units are disposed; wherein the cleaning unit is sized to extend approximately the length of the opposite side.

12. The electrophotographic printing apparatus of claim 11, wherein the cleaning unit has a volume over 820 $cm^3$.

13. An electrophotographic apparatus comprising:

a photoreceptor belt having an outer surface;

a support member operably disposed to support the movement of the photoreceptor belt along a path, the photoreceptor belt having a shape defined, at least in part, by the support member, the shape of the photoreceptor belt having at least two sides meeting at a transfer point, the first of the two sides extending at a first angle measured from the outer surface of the photoreceptor belt to a horizontal axis of the apparatus at the transfer point and the second of the two sides extending at a second angle measured from the outer surface of the photoreceptor belt to the horizontal axis at the transfer point, the first and the second angles are each less than 90°;

a plurality of developing units, each developing unit disposed adjacent to one of the first and second sides of the shape of the photoreceptor belt;

a cleaning unit disposed adjacent to a side opposite to the one of the first and second sides where the plurality of developing units are disposed;

a housing enclosing the photoreceptor belt, the supporting member, and the cleaning unit; and a waste container removably coupled to an end of the cleaning unit and disposed within the housing such that the waste container is in a vertical plane of the housing different from the photoreceptor belt.

14. An electrophotographic apparatus comprising:

a photoreceptor belt having an outer surface;

a support member operably disposed to support the movement of the photoreceptor belt along a path, the photoreceptor belt having a shape defined, at least in part, by the support member, the shape of the photoreceptor belt having at least two sides meeting at a transfer point, the first of the two sides extending at a first angle measured from the outer surface of the photoreceptor belt to a horizontal axis of the apparatus at the transfer point and the second of the two sides extending at a second angle measured from the outer surface of the photoreceptor belt to the horizontal axis at the transfer point, the first and the second angles are each less than 90°; and a plurality of developing units, each developing unit disposed adjacent to one of the first and second sides of the shape of the photoreceptor belt;

wherein the support member is one of a plurality of support members defining the shape of the photoreceptor belt;

wherein the plurality of support members includes a lower member disposed at the transfer point and two upper members, the first side of the shape extending from one of the two upper members to the lower member and the second side of the shape extending from the lower member to another of the two upper members.

15. The electrophotographic printing apparatus of claim 14, wherein the shape of the photoreceptor belt is non-equilateral triangular defined by the lower member and the two upper members.

16. The electrophotographic printing apparatus of claim 14, further comprising a transfer unit having a roller disposed adjacent to the lower member, the roller is adapted to move in unison with the photoreceptor belt when a substrate sheet is fed between the roller of the transfer unit and the lower member so that a developed latent image on the photoreceptor belt is transferred to the substrate sheet.

17. The electrophotographic printing apparatus of claim 14, a transfer unit having a roller disposed adjacent to the lower member, the roller is adapted to move in unison with the photoreceptor belt when a substrate sheet is fed between the roller of the transfer unit and the lower member so that a developed latent image on the photoreceptor belt is transferred to the substrate sheet;

wherein the roller of the transfer unit and the lower member are substantially aligned vertically.

18. The electrophotographic printing apparatus of claim 14, a transfer unit having a roller disposed adjacent to the lower member, the roller is adapted to move in unison with the photoreceptor belt when a substrate sheet is fed between the roller of the transfer unit and the lower member so that a developed latent image on the photoreceptor belt is transferred to the substrate sheet;

further comprising a fuser unit disposed to receive the substrate sheet from the roller of the transfer unit, the transfer unit having a non-moving support member disposed between the roller and the fuser unit for supporting the substrate sheet when the substrate sheet is received by the fuser unit.

19. An electrophotographic apparatus comprising:

a photoreceptor belt having an outer surface;

a support member operably disposed to support the movement of the photoreceptor belt along a path, the photoreceptor belt having a shape defined, at least in part, by the support member, the shape of the photoreceptor belt having at least two sides meeting at a transfer point, the first of the two sides extending at a first angle measured from the outer surface of the photoreceptor belt to a horizontal axis of the apparatus at the transfer point and the second of the two sides extending at a second angle measured from the outer surface of the photoreceptor belt to the horizontal axis at the transfer point, the first and the second angles are each less than 90°;

a plurality of developing units, each developing unit disposed adjacent to one of the first and second sides of the shape of the photoreceptor belt; and a plurality of charging units, each charging unit is disposed adjacent to the outer surface of the photoreceptor belt, a first of the plurality of charging units is disposed upstream of the plurality of developing units with respect to a direction of movement of the photoreceptor belt, a second of the plurality of charging units is disposed upstream of a portion of the plurality of developing units with respect to the direction of movement of the photoreceptor belt.

20. The electrophotographic printing apparatus of claim 19, further comprising a plurality of exposure units, each exposure unit is disposed adjacent to the photoreceptor belt, a first of the exposure units is disposed downstream of the first charging unit with respect to the direction of movement of the photoreceptor belt, a second of the exposure units is disposed downstream of the second charging unit with respect to the direction of movement of the photoreceptor belt.

21. The electrophotographic printing apparatus of claim 20, wherein each of the developing units has an associated toner of a different color.

22. The electrophotographic printing apparatus of claim 21, further comprising a control means for selectively causing the first and second charging units to each provide an electrostatic charge on a region of the photoreceptor belt during one pass of the photoreceptor belt for causing the first and second exposure units to expose the region when selectively charged to produce a corresponding latent image on the region during the one pass of the photoreceptor belt, and for selectively causing a first of the developing units to develop the latent image corresponding to the first exposure unit and a second of the developing units to develop the latent image corresponding to the second exposure unit such that a developed latent image having two colors is produced on the region after the one pass of the photoreceptor belt.

23. The electrophotographic printing apparatus of claim 22, wherein the control means is further configured for selectively causing a third of the developing units to develop the latent image corresponding to the first exposure unit and a fourth of the developing units to develop the latent image corresponding to the second exposure unit such that the developed latent image has four colors after two successive passes of the photoreceptor belt.

24. The electrophotographic printing apparatus of claim 20, further comprising:

a bias means operably coupled to one of the plurality of support members for biasing the one support member towards the photoreceptor belt to maintain a tension on the photoreceptor belt; and a first holding member disposed between the first charging unit and the one support member, the holding member contacting the photoreceptor belt such that the holding member substantially inhibits a variation of a length of the photoreceptor belt between the first charging unit and the first exposure unit in response to biasing the one support member towards the photoreceptor belt.

25. The electrophotographic printing apparatus of claim 20, further comprising a plurality of holding members, each holding member disposed to be in contact with the photoreceptor belt near a respective one of the plurality of developing units such that each holding member substantially maintains a respective gap between the holding member and the respective one of the plurality of developing units.

26. An electrophotographic printing apparatus of claim 19, further comprising a plurality of eraser units, each eraser unit is disposed adjacent to the photoreceptor belt and upstream of a respective one of the plurality of charging units with respect to the direction of movement of the photoreceptor belt.

27. An electrophotographic printing apparatus comprising:

a photoreceptor belt having an outer surface;

a support member having a lower apex and operably disposed to support the movement of the photoreceptor belt along a path, the photoreceptor belt having a shape defined by the support member, the shape of the photoreceptor belt having at least two sides meeting at a transfer point corresponding to the lower apex of the support member, the first of the two sides extending at a first angle measure from the outer surface of the photoreceptor belt to a horizontal axis of the apparatus at the transfer point and the second of the two sides extending at a second angle measured from the outer surface of the photoreceptor belt to the horizontal axis at the transfer point, the first and the second angles are each less than 90°;

a plurality of developing units, each developing unit disposed adjacent to one to the first and second sides of the shape of the photoreceptor belt; and a transfer unit having a roller disposed adjacent to the lower apex of the support member at the transfer point, the roller is adapted to move in unison with the photoreceptor belt when a substrate sheet is fed between the roller of the transfer unit and the support member so that a developed latent image on the photoreceptor belt is transferred to the substrate sheet.

28. The electrophotographic printing apparatus of claim 27, wherein the support member is comprised of a lower member that corresponds to the lower apex of the support member and at least two members, the first side of the shape extending from one of the two upper members to the lower member and the second side of the shape extending from the lower member to another of the two upper members.

29. The electrophotographic printing apparatus of claim 27, wherein the roller of the transfer unit and the lower apex of the support member are substantially aligned vertically.

30. The electrophotographic printing apparatus of claim 27, further comprising a fuser unit disposed to receive the substrate sheet from the roller of the transfer unit, the transfer unit having a non-moving support member disposed between the roller and the fuser unit for supporting the substrate sheet when the substrate sheet is received by the fuser unit.

31. The electrophotographic printing apparatus of claim 27, wherein the plurality of developing units are staggered vertically along the one of the first and second sides of the shape of the photoreceptor belt.

32. An electrophotographic printing apparatus comprising:

a photoreceptor belt having an outer surface;

a support member having a lower apex and operably disposed to support the movement of the photoreceptor belt along a path, the photoreceptor belt having a shape defined by the support member, the shape of the photoreceptor belt having at least two sides meeting at a transfer point corresponding to the lower apex of the support member, the first of the two sides extending at a first angle measure from the outer surface of the photoreceptor belt to a horizontal axis of the apparatus at the transfer point and the second of the two sides extending at a second angle measured from the outer surface of the photoreceptor belt to the horizontal axis at the transfer point, the first and the second angles are each less than 90°;

a plurality of developing units, each developing unit disposed adjacent to one to the first and second sides of the shape of the photoreceptor belt; and a transfer unit having a roller disposed adjacent to the lower apex of the support member at the transfer point, the roller is adapted to move in unison with the photoreceptor belt when a substrate sheet is fed between the roller of the transfer unit and the support member so that a developed latent image on the photoreceptor belt is transferred to the substrate sheet;

wherein the support member is comprised of a lower member that corresponds to the lower apex of the support member and at least two members, the first side of the shape extending from one of the two upper members to the lower member and the second side of the shape extending from the lower member to another of the two upper members; wherein the shape of the photoreceptor belt is non-equilateral triangular defined by the lower member and the two upper members.

* * * * *